US010675554B2

(12) United States Patent
Bowman

(10) Patent No.: US 10,675,554 B2
(45) Date of Patent: Jun. 9, 2020

(54) HURDLE SYSTEM AND METHOD

(71) Applicant: Trevor Bowman, Burleigh Heads (AU)

(72) Inventor: Trevor Bowman, Burleigh Heads (AU)

( * ) Notice: Subject to any disclaimer, the term of this patent is extended or adjusted under 35 U.S.C. 154(b) by 489 days.

(21) Appl. No.: 15/380,315

(22) Filed: Dec. 15, 2016

(65) Prior Publication Data

US 2018/0169454 A1 Jun. 21, 2018

(51) Int. Cl.
*A63K 3/04* (2006.01)

(52) U.S. Cl.
CPC ..... *A63K 3/043* (2013.01)

(58) Field of Classification Search
CPC ..... A63K 3/04–046; A63B 5/16; A63B 3/00; A63B 1/00–04; A63B 21/00047
See application file for complete search history.

(56) References Cited

U.S. PATENT DOCUMENTS

| | | | | |
|---|---|---|---|---|
| D368,288 | S * | 3/1996 | Kasbohm | D21/686 |
| 9,713,741 | B1 * | 7/2017 | Tolliver | A63B 23/12 |
| 2009/0098985 | A1 * | 4/2009 | Gonzalez | A63B 69/004 482/83 |
| 2009/0137372 | A1 * | 5/2009 | Gates | A63B 21/078 482/142 |

* cited by examiner

*Primary Examiner* — Jennifer Robertson
(74) *Attorney, Agent, or Firm* — Nwamu, PC

(57) ABSTRACT

A hurdle system and method. The hurdle system has a telescoping interior arm and a non-telescoping exterior arm. The telescoping interior arm has spaced-apart cylindrical apertures that allow the height of the telescoping interior arm to be locked. A hurdle cross bar support fixedly attaches to a distal end of the telescoping interior arm. A hurdle cross bar is supported by the hurdle cross bar support in a parallel relationship. A bottom cross bar is placeable on the ground as support base for the hurdle. A proximal end of the non-telescoping exterior arm and the bottom cross bar are fixedly attached. A pair of bottom cross bar extensions extend from opposite ends of the bottom cross bar to provide additional stability. A position adjustable counterweight at the bottom cross bar maintains the hurdle in an upright position.

16 Claims, 7 Drawing Sheets

HURDLE SYSTEM AND METHOD

BACKGROUND

The present disclosure relates generally to a hurdle system and method and more specifically to a hurdle system and method for raising and lowering a cross hurdle bar.

A track hurdle is a movable section of light fence that can be vaulted at athletic track and field competition events. The hurdle provides a barrier that must be vaulted to continue on a path. The height of the hurdle is determined by the age and gender of the athlete.

Generally, the track hurdle uses two height adjustable vertical arms to raise and lower a hurdle cross bar and to maintain the hurdle cross bar at a generally horizontal position. A user such as a worker at an athletic event, typically begins the height adjustment process by adjusting the first vertical arm to a desired height. Specifically, the user dislodges the first vertical arm from its current position, and then moves the dislodged first vertical arm either upwards or downwards to the desired position.

The user then sets the first vertical arm in the desired position. Typically, during the entirety of the process, the user generally must use both hands to achieve adjustment of the vertical arm. Moreover, upon adjustment of the first vertical arm, the hurdle cross bar attached to the top end of the first vertical arm is lopsided relative to the second vertical arm to which the other end of the hurdle cross bar is attached.

After adjustment of the first vertical arm is completed, the user must then move over to the second vertical arm to repeat the process again. Specifically, the user must again dislodge the second vertical arm from its current position, move this dislodged second vertical arm either upwards or downwards to the desired location, after which the second vertical arm is set in the desired position. Again, during the entirety of the process of adjusting the second vertical arm, the user generally must use both hands to achieve adjustment of this second vertical arm. Only after the second vertical arm is adjusted, can the hurdle cross bar maintain its horizontal position.

In a typical athletic track meet, the number of track hurdles can be up to 100 track hurdles. After the user completes adjustment of the first track hurdle including the first vertical arm and the second vertical arm, the user must proceed to the next track hurdle, and the next, repeating the process again until all of the 100 track hurdles are adjusted.

After all of track hurdles have been adjusted to the position required for competition, only then can competition occur. Here, the competition might be for a male adult event which requires a particular height for the track hurdles. It is typical for an athletic event to be followed by another type of gender and/or age event, which requires a different height for the track hurdles. Thus, if the male adult event is followed by a female adult event, the user must again readjust all of the 100 track hurdles for the female adult event.

It is within the aforementioned context that a need for the present disclosure has arisen. Thus, there is a need to address one or more of the foregoing disadvantages of conventional systems and methods, and the present disclosure meets this need.

BRIEF SUMMARY

Various aspects of a hurdle system and method can be found in exemplary embodiments of the present disclosure.

In a first embodiment, the hurdle system and method includes a single-armed track hurdle having a telescoping interior arm and a non-telescoping exterior arm. A proximal end of the telescoping interior arm is positioned, at least in part, within a hollow cavity of the non-telescoping exterior arm. The telescoping interior arm may be raised or lowered within the cavity due in part to the telescoping interior arm having an exterior cross sectional length sized to correspond with an interior cross sectional length of the single non-telescoping exterior arm.

In this manner, a user or worker at an athletic event, need not undergo a process of adjusting both a first vertical arm and a second vertical arm. And, then repeating the process for each and every one of the 100 track hurdles that might be present at an athletic track meet. Specifically, time, effort and money are saved because after a first vertical arm is adjusted, the user need not move over to a second vertical arm, then dislodge the arm from its current position, and then reset it at a desired position, then ensure that the hurdle cross bar is horizontal and not lopsided. The user need not generally use both hands to achieve adjustment of the single vertical arm of the present disclosure. And even more significant, upon adjustment of the first vertical arm, the hurdle cross bar immediately maintains a horizontal position and does not become lopsided as in conventional track hurdles.

Therefore, the user worker can quickly and efficiently adjust all of the track hurdles in less than half the time it would take to adjust typical conventional track hurdles. If an event is followed by another gender or age event, which mandates use of a different height requirement for the track hurdles, unlike conventional track hurdles, the track hurdles of the present disclosure can again be readjusted, quickly and efficiently so as to save time, money and effort and facilitate completion of the athletic meet in a timely manner.

In one embodiment, the telescoping interior arm has a plurality of spaced-apart cylindrical apertures that allow the height of the telescoping interior arm to be locked at a desired height. The hurdle further provides a hurdle cross bar that is supported by a hurdle cross bar support in a parallel relationship. The hurdle cross bar support extends along a horizontal direction forming a surface on which the hurdle cross bar is placed. A proximal end of the hurdle cross bar and a proximal end of the hurdle cross bar support are fixedly attached, while a distal end of the hurdle cross bar and a distal end of the hurdle cross bar support are fixedly attached.

The hurdle cross bar support fixedly attaches to a distal end of the telescoping interior arm at a point generally midway between opposite ends of the hurdle cross bar support. In this manner, the hurdle cross bar support is disposed generally perpendicular to the telescoping interior arm, which is disposed in a substantially upright direction.

The hurdle further provides a bottom cross bar that is placeable on the ground as support base for the hurdle. A proximal end of the non-telescoping exterior arm and the bottom cross bar are fixedly attached at a point that is generally midway between opposite ends of the bottom cross bar.

A pair of bottom cross bar extensions extend from opposite ends of the bottom cross bar to provide additional stability to the hurdle. The hurdle further provides a counterweight to provide a tip over counterweight at various hurdle heights. The counterweight is positioned in the bottom cross bar.

A further understanding of the nature and advantages of the present disclosure herein may be realized by reference to the remaining portions of the specification and the attached drawings. Further features and advantages of the present disclosure, as well as the structure and operation of various embodiments of the present disclosure, are described in detail below with respect to the accompanying drawings. In the drawings, the same reference numbers indicate identical or functionally similar elements.

DETAILED DESCRIPTION

Reference will now be made in detail to the embodiments of the disclosure, examples of which are illustrated in the accompanying drawings. While the disclosure will be described in conjunction with the preferred embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth to provide a thorough understanding of the present disclosure. However, it will be obvious to one of ordinary skill in the art that the present disclosure may be practiced without these specific details. In other instances, well-known methods, procedures, components, and circuits have not been described in detail as to not unnecessarily obscure aspects of the present disclosure.

Figure 1:
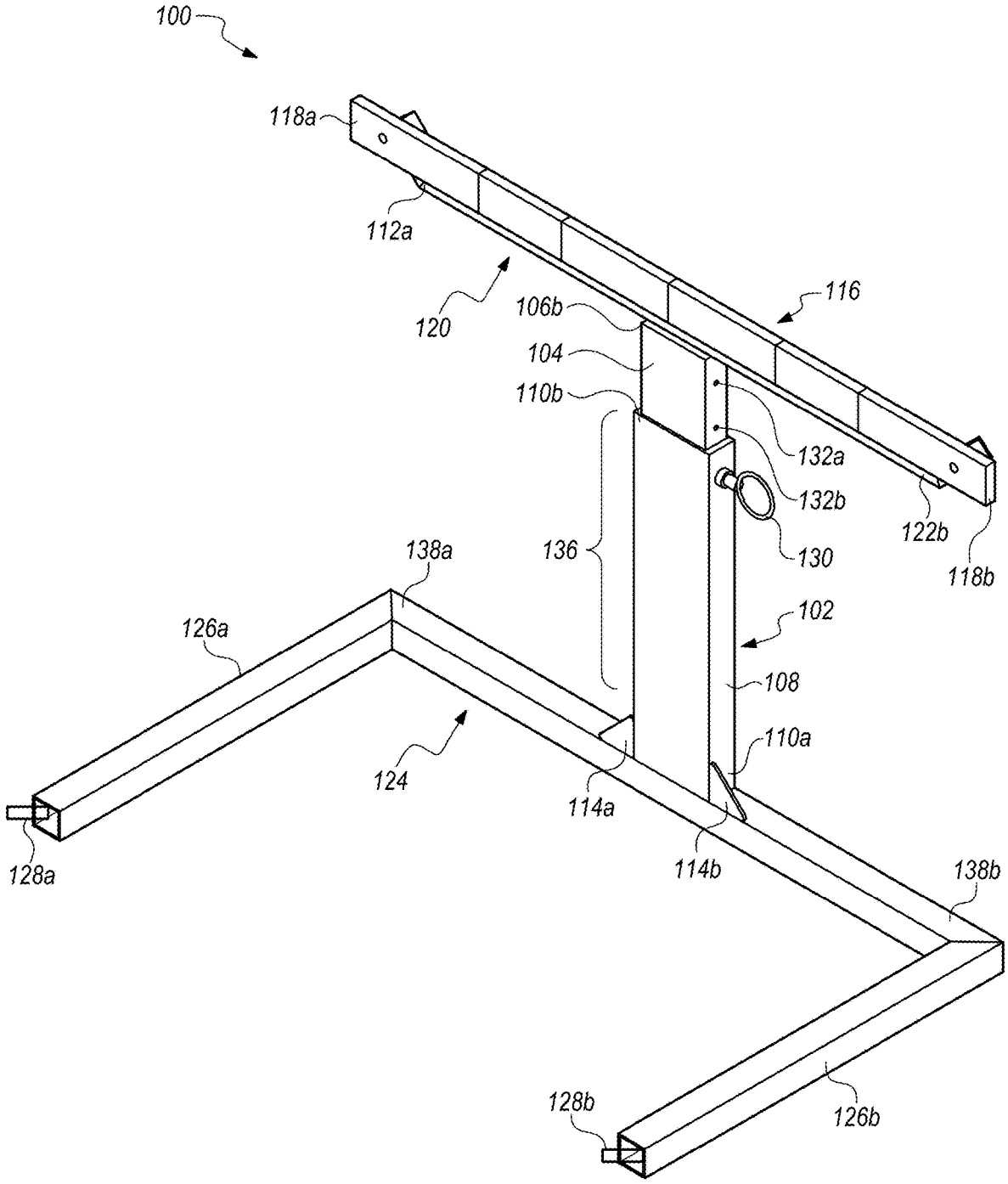
FIG. 1 illustrates a perspective view of a single armed telescoping hurdle according to an exemplary embodiment of the present disclosure.

FIG. 1 illustrates a perspective view of a single armed telescoping hurdle 100 according to an exemplary embodiment of the present disclosure.

In FIG. 1, the single armed telescoping hurdle 100 provides a hurdle having a telescoping, single leg to provide a height adjustable obstacle for an athlete or other hurdler. In one embodiment, the hurdle 100 forms a jumping obstacle for an athletic track and field event.

The hurdle 100 utilizes a single leg 102 to telescopically raise and lower a hurdle cross bar 116, so as to facilitate the height adjustment of the hurdle cross bar 116, and also helps maintain the hurdle cross bar 116 at a generally horizontal disposition. In this manner, the hurdle cross bar 116 may be easily raised and lowered while remaining in a horizontal position.

Additionally, at least one position adjustable counterweight 128*a*, 128*b* integrates into a bottom cross bar 124 near the base of the hurdle 100 to provide tip over counter weights at various hurdle heights. Together, the telescopic raising and lowering of a single leg 102, and the unique position of the counterweight 128*a*, 128*b* at the base of the hurdle enable facilitated height adjustment and safe operation of the hurdle 100.

Figure 2A:
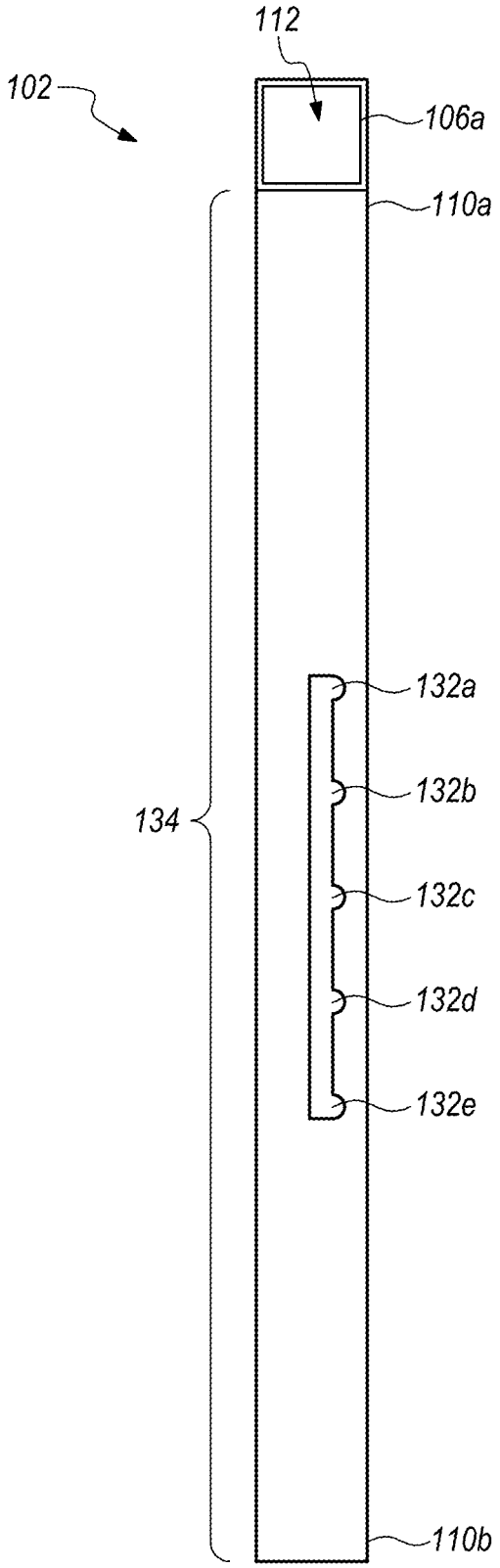
FIG. 2A illustrates a sectioned left inside side view of a single leg for a single armed telescoping hurdle according to an exemplary embodiment of the present disclosure.

FIG. 2A illustrates a sectioned left inside side view of a single leg 102 for a single armed telescoping hurdle 100 according to an exemplary embodiment of the present disclosure.

The hurdle 100 has a single leg 102 that telescopically raises and lowers a hurdle cross bar 116 to a desired height, and then locks the hurdle cross bar 116 at the selected height. A plurality of spaced-apart apertures 132*a-e* along the length of the single leg 102 enable passage of a pin 130 to lock the single leg 102 at a desired height.

In this manner, multiple vertical arms are not required to adjust the height of the hurdle 100, which expedites the operation of raising and lowering the hurdle cross bar 116. This expedited manipulation of the hurdle can be advantageous when numerous hurdles require height adjustment at an event. Additionally, by raising and lowering the hurdle cross bar 116 with a single, centrally positioned leg the hurdle cross bar 116 can more easily maintain a horizontal disposition.

Figure 2B:
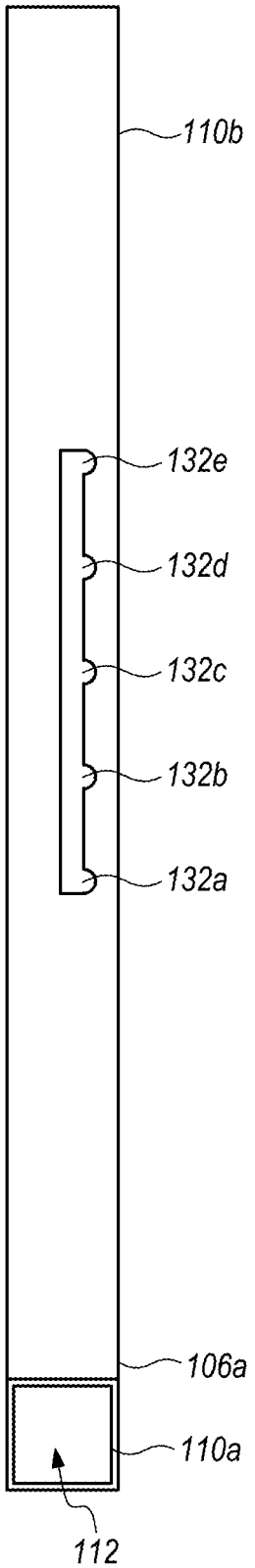
FIG. 2B illustrates a sectioned right inside side view of the single leg shown in FIG. 2A according to an exemplary embodiment of the present disclosure.

In a first embodiment shown in FIG. 2B, the hurdle 100 provides a single leg 102 having a telescoping interior arm 104 and a non-telescoping exterior arm 108 that form a sliding relationship. A proximal end 106*a* of the telescoping interior arm 104 is positioned, at least in part, within a hollow cavity 112 of the non-telescoping exterior arm 108. The telescoping interior arm 104 is mobile, sliding up and down the static non-telescoping exterior arm 108.

In this manner, the telescoping interior arm 104 may be raised or lowered within the cavity 112 of the non-telescoping exterior arm 108 to achieve a desired height. This sliding relationship is due in part to the telescoping interior arm 104 having an exterior cross sectional length 134 that is sized to correspond with an interior cross sectional length 136 of the non-telescoping exterior arm 108.

In one embodiment, the telescoping interior arm 104 and the non-telescoping exterior arm 108 have a generally elongated cubicle shape. Though in other embodiments, the legs 104, 108 may have cylindrical or triangular shapes. Suitable materials for the single leg 102 may include, without limitation, metal, rigid polymers, fiberglass, and wattle.

Further, the telescoping interior arm 104 has a plurality of spaced-apart cylindrical apertures 132*a-e* that enable passage of a locking pin 130 to secure the desired height of the telescoping interior arm 104, as discussed below.

Figure 3:
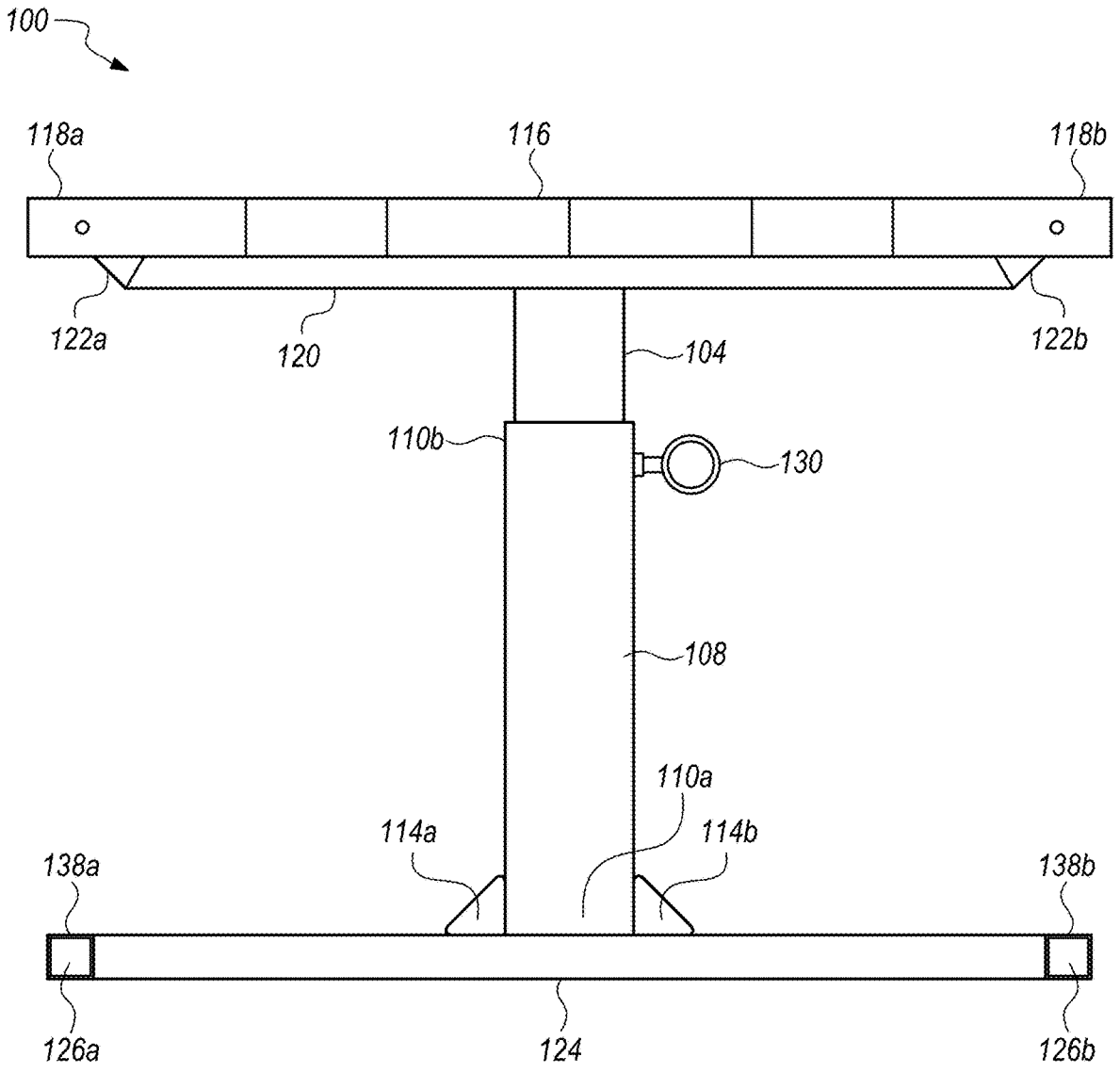
FIG. 3 illustrates a frontal view of the single armed telescoping hurdle shown in FIG. 1 according to an exemplary embodiment of the present disclosure.

As referenced in FIG. 3, the hurdle 100 further provides a hurdle cross bar 116 that forms the highest point of the hurdle 100. The hurdle cross bar 116 is, in essence, a horizontal barrier that an athlete must clear during competition. The hurdle cross bar 116 must remain in a substantially horizontal disposition to provide a fair competitive obstacle for the hurdler.

The hurdle cross bar 116 is supported by a hurdle cross bar support 120. The hurdle cross bar 116 and the hurdle cross bar support 120 are in a parallel relationship, with hurdle cross bar 116 resting planar on hurtle cross bar support 120. In one embodiment, the hurdle cross bar support 120 extends along a horizontal direction forming a surface on which the hurdle cross bar 116 is placed.

The hurdle cross bar 116 and the hurdle cross bar support 120 are fixedly attached together. In one embodiment, a proximal end 118*a* of the hurdle cross bar 116 and a proximal end 122*a* of the hurdle cross bar support 120 are fixedly attached. Also, a distal end 118*b* of the hurdle cross bar 116 and a distal end 122*b* of the hurdle cross bar support 120 are fixedly attached. In another embodiment, the hurdle cross bar support 120 is defined by a slot that receives the hurdle cross bar 116. Though other fastening means, including bolts, magnets, and adhesives may be used to secure the hurdle cross bar 116 to the hurdle cross bar support 120.

The hurdle cross bar support 120 is generally perpendicular to the single leg 102. In this manner, the hurdle cross bar 116 maintains a horizontal disposition. Those skilled in the art will recognize that hurdlers require a horizontal hurdle cross bar 116 to hurdle over. A competitive disadvantage occurs with a sloped hurdle cross bar.

The hurdle cross bar 116 can be moved to a desired height with one upright movement while the hurdle cross bar 116 remains horizontal during displacement. Those skilled in the art will recognize that hurdle cross bars in conventional hurdles are moved one end at a time and rely on more than one upright leg to secure the hurdle cross bar 116 in a horizontal position.

Thus, the use of a single leg 102 to raise and lower the hurdle cross bar 116 creates a more uniform horizontal disposition for the hurdle cross bar 116 than multiple legs because there are fewer legs to manipulate for raising and lowering the hurdle cross bar 116.

In one embodiment, the hurdle cross bar support 120 fixedly attaches to a distal end 106*b* of the telescoping interior arm 104 at a point generally midway between opposite ends of the hurdle cross bar support 120. This forms a generally perpendicular disposition therebetween.

The distal end 106*b* of the telescoping interior arm 104 may fixedly attach to the hurdle cross bar support 120 through various means, including welding, bolts, and threaded projections extending from the telescoping interior arm 104 that engage threaded openings in the hurdle cross bar 116. In this manner, the hurdle cross bar support 120 is fixedly disposed in a generally perpendicular, horizontal disposition to the substantially upright direction of the telescoping interior arm 104.

Figure 4:
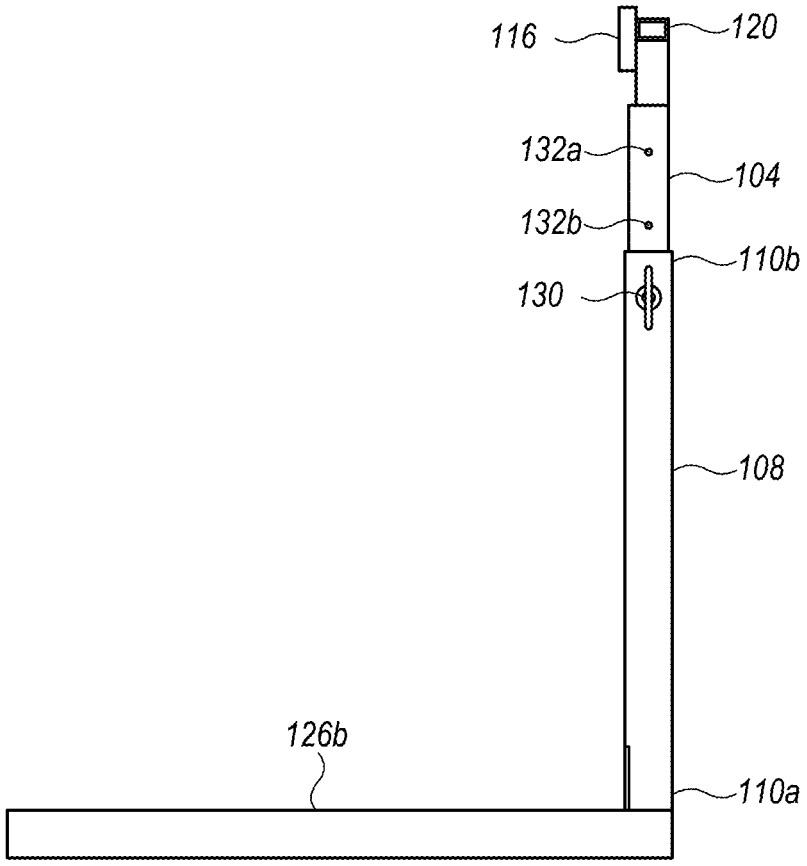
FIG. 4 illustrates an elevated side view of the single armed telescoping hurdle shown in FIG. 1 according to an exemplary embodiment of the present disclosure.

As FIG. 4 illustrates, the hurdle 100 provides a bottom cross bar 124 that is placeable on the ground as support base for the hurdle 100. The bottom cross bar 124 is disposed generally parallel, and directly beneath the hurdle cross bar support 120.

The bottom cross bar 124 fixedly attaches to the non-telescoping exterior arm 108. In one embodiment, a proximal end 110*a* of the non-telescoping exterior arm 108 and the bottom cross bar 124 are fixedly attached at a point that is generally midway between opposite ends of the bottom cross bar 124.

As FIG. 3 illustrates, at least one bracket 114*a*, 114*b* at this junction may be used to increase the structural integrity of this fixed relationship. The bracket 114*a*, 114*b* may include a triangular panel that abuts the non-telescoping exterior arm 108 and the bottom cross bar 124.

Figure 5:
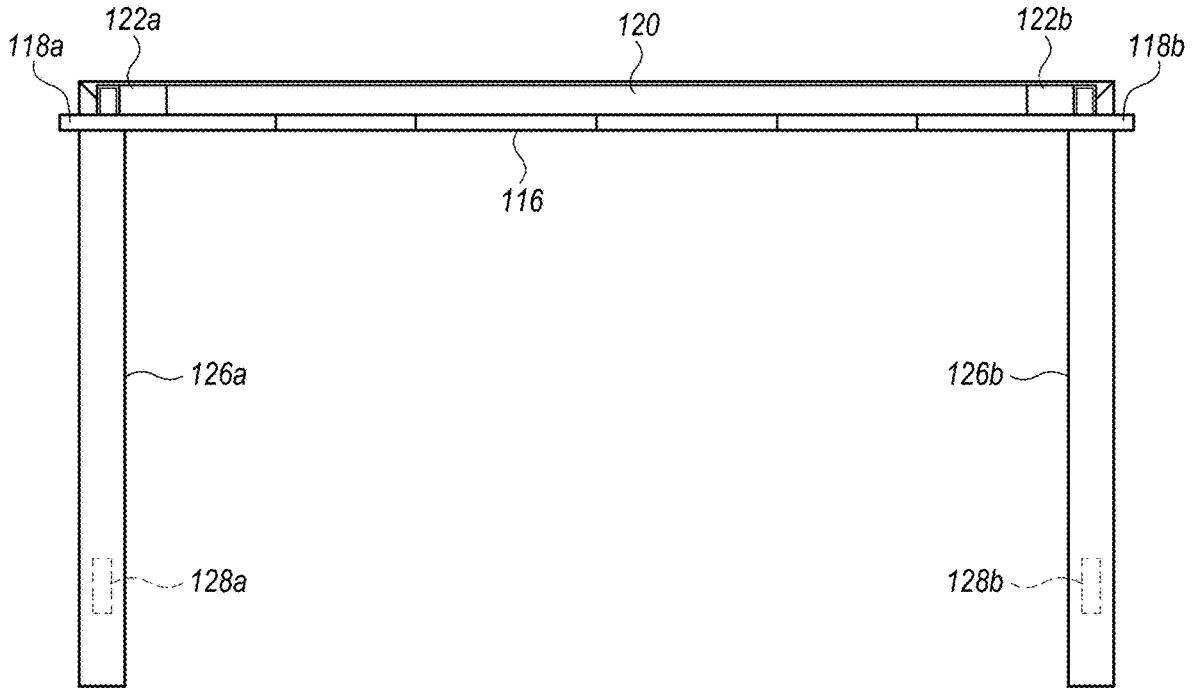
FIG. 5 illustrates a top view of the single armed telescoping hurdle shown in FIG. 1 according to an exemplary embodiment of the present disclosure.

Turning now to FIG. 5, a pair of bottom cross bar extensions 126*a*, 126*b* extend from opposite ends 138*a*, 138*b* of the bottom cross bar 124 to provide additional stability to the hurdle so that the hurdle maintains an upright position. The bottom cross bar extensions 126*a*, 126*b* provide additional stability to the base of the hurdle 100 by orienting perpendicular to the bottom cross bar 124.

The bottom cross bar extensions 126*a*, 126*b* form a spaced-apart, parallel relationship to each other. The bottom cross bar extensions 126*a*, 126*b* may fixedly attach to the bottom cross bar 124 through various means, including welding, bolts, and threaded projections extending from the bottom cross bar extensions 126*a*, 126*b* that engage threaded openings in the bottom cross bar 124.

Those skilled in the art will recognize that an athlete may accidently engage the hurdle cross bar 116 while jumping over. Specifically, during a track meet, an athlete typically vaults over the track hurdle and would sometimes accidently engage the hurdle cross bar. As noted, the hurdle cross bar is attached to the first vertical arm and the second vertical arm to maintain a horizontal position. As a result of engagement of the hurdle cross bar with two vertical arms, the track hurdle cross bar might sometimes tip over depending upon the force applied. The athlete would sometimes contact the tipped over track hurdle. Depending upon the contact force, serious injury to the athlete may result.

In one alternative embodiment, the bottom cross bar 124 hingedly attaches to a single point of the non-telescoping exterior arm 108. In this manner, the single leg 102 collapses when a predetermined force is applied to the hurdle cross bar 116. This may include an athlete engaging the hurdle cross bar 116 at a tip over weight between about 3.6 to 4.0 kilograms.

In one alternative embodiment, the single leg 102 is hinged at the junction with the bottom cross bar 124, and locked in an upright position with pressure latches. Once the tip over weight is applied to the hurdle cross bar 116, the latches release the single leg 102, allowing the hurdle cross bar 116 to collapse coplanar to the ground. The bottom cross bar extensions 126*a*, 126*b* remain coplanar to the ground, so as not to injure the hurdler.

Those skilled in the art will recognize that this collapsible feature provides a safety advantage, as serious injuries have been known to occur with athletes running into vertical arms from a toppled hurdle.

The bottom cross bar extensions 126*a*, 126*b* also work with the bottom cross bar 124 and the counterweight 128*a*, 128*b* to provide tip over counterweights at various hurdle heights. For example, the bottom cross bar extensions 126*a*, 126*b* join the bottom cross bar 124 in a generally perpendicular disposition to maintain stability in two coplanar directions. The bottom cross bar extensions 126*a*, 126*b* also receive the counterweights 128*a*, 128*b* to balance the tip over force that may be applied to the hurdle cross bar 116.

As discussed above, the single leg 102 includes a plurality of spaced-apart cylindrical apertures 132*a-e*. The apertures 132*a-e* position along the exterior cross sectional length of the telescoping interior arm 104. The apertures 132*a-e* are configured to raise or lower the hurdle cross bar 116 at a midway point of the hurdle cross bar 116.

In one embodiment, five apertures 132*a-e* align along the telescoping interior arm 104. In one embodiment, the apertures includes a top aperture 132*a*, an adjacent second aperture 132*b*, a third aperture 132*c*, a fourth aperture 132*d*, and a fifth aperture 132*e*. The apertures 132*a-e* may have other shapes beyond cylindrical, including square, triangular, and rectangular shapes.

A pin 130 may be used to selectively pass through one of the apertures 132*a-e* in the telescoping interior arm 104, and an opening in the non-telescoping exterior arm 108 to set the hurdle cross bar 116 at a desired height. The pin 130 holds the telescoping interior arm 104 stationary relative to the exterior non-telescopic exterior arm 108. In this manner, the height of the telescoping interior arm 104 is height adjustable relative to the non-telescoping exterior arm 108 through selective placement of the pin 130 through one of the apertures 132*a-e*.

In another alternative embodiment, the telescoping interior telescoping leg 104 may be raised and lowered through use of a gas strut. The gas strut enables upward movement of the interior telescoping leg 104 when a latch is released. Release of the latch would cause the hurdle cross bar 116 to be displaced to an adjacent height position, corresponding to the selected aperture 132*b*. In this manner, the hurdle cross bar 116 locks into the next highest 132*a* if the latch is released.

Conversely, to lower the hurdle cross bar 116, downward pressure is applied to the hurdle cross bar 116 until the desired height is achieved. It is significant to note that use of a gas strut in this manner is generally impractical with a hurdle having multiple legs.

The hurdle 100 further provides at least one counterweight 128*a*, 128*b* to help maintain the hurdle in an upright position, and especially when a force is applied across the hurdle cross bar 116. Those skilled in the art will recognize that maintaining a horizontal tip over weight of 3.6-4.0 kilograms is ideal for all heights. The counterweight 128*a*, 128*b* provides this counterbalancing feature for the hurdle 100.

The counterweight 128*a*, 128*b* positions along a section of the length of the bottom cross bar 124. The counterweight 128*a*, 128*b* may be repositioned at different sections of the bottom cross bar 124 to correspond with the height of the hurdle cross bar 116. In one embodiment, a single counterweight 128*a*, 128*b* may be integrated into each bottom cross bar extension 126*a*, 126*b*.

In one exemplary use, the counterweight 128*a*, 128*b* positions proximally to the bottom cross bar 124 when the hurdle cross bar 116 is at a low height. The higher the hurdle cross bar 116, the further the counterweight 128*a*, 128*b* is positioned away from the bottom cross bar 124 to maintain the hurdle 100 in the upright position. For example, a pair of weighted metal block positioned in the bottom cross extensions 126*a*, 126*b* is moved closer or further away from the ground bar and coincides with cross bar height positions.

The counterweight 128*a*, 128*b* may be manually repositioned along the pair of bottom cross bar extensions 126*a*, 126*b*. However, in other embodiments, the counterweight 128*a*, 128*b* may be displaced automatically through various mechanisms. In one alternative embodiment, a pulley and a cable are operable with the counterweight 128*a*, 128*b* to reposition the counterweight 128*a*, 128*b* to a desired section of the bottom cross bar 124. The pulley and the cable are interposed between the pair of bottom cross bar extensions 126*a*, 126*b* and the single leg 102 to adjust the position of the counterweight 128*a*, 128*b* in the bottom cross bar extensions 126*a*, 126*b*.

Figure 6:
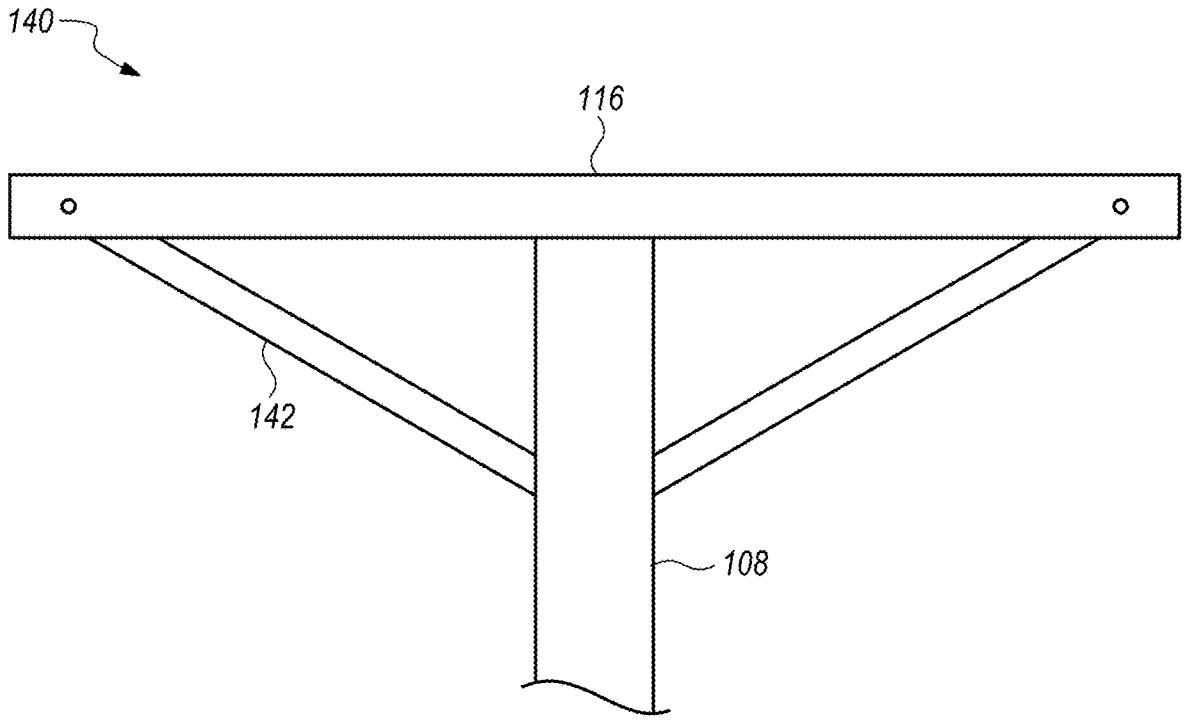
FIG. 6 illustrates a front view of a single armed telescoping hurdle having a V-shaped hurdle cross bar support according to an exemplary embodiment of the present disclosure.

FIG. 6 illustrates a front view of a single armed telescoping hurdle 140 having a V-shaped hurdle cross bar support 142 according to an exemplary embodiment of the present disclosure.

In one alternative embodiment, an alternative version of the hurdle 140 provides a hurdle cross bar support 142 that has a generally V-shape. In this V-shaped configuration, the hurdle cross bar support 142 extends between the hurdle cross bar 116 and the distal end 110*b* of the non-telescoping exterior arm 108 at an angle. This angled configuration creates a unique bracketed support that enhances the structural integrity of the hurdle cross bar 116 in the horizontal position.

Figure 7:
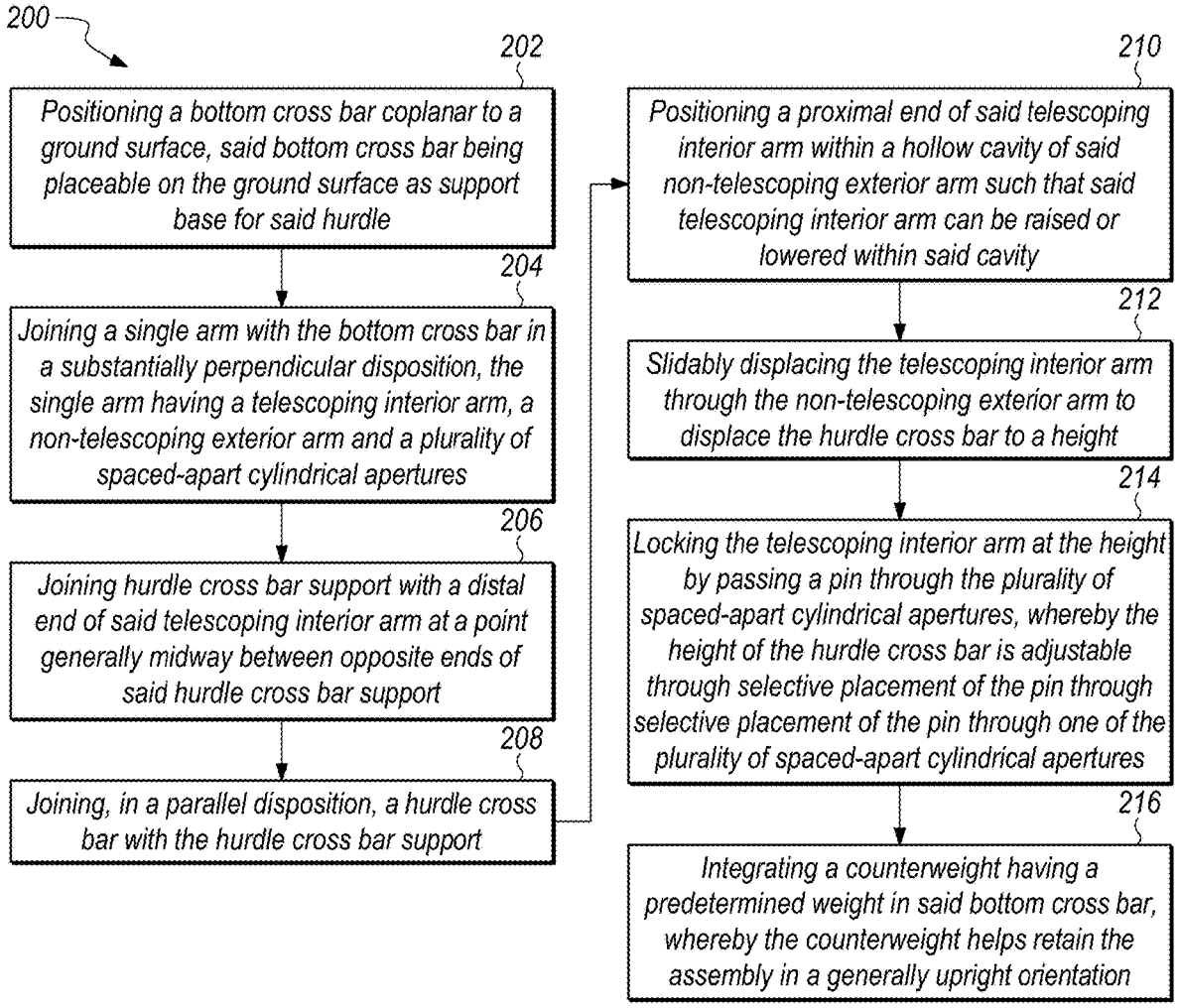
FIG. 7 illustrates a flowchart of a method for constructing a single armed telescoping hurdle according to an exemplary embodiment of the present disclosure.

FIG. 7 illustrates a flowchart of a method 200 for constructing a single armed telescoping hurdle according to an exemplary embodiment of the present disclosure.

The method 200 may include an initial Step 202 of positioning a bottom cross bar coplanar to a ground surface, said bottom cross bar being placeable on the ground surface as support base for said hurdle. The bottom cross bar 124 provides stability to the hurdle 100. A pair of bottom cross bar extensions 126*a*, 126*b* extend from opposite ends 138*a*, 138*b* of the bottom cross bar 124 to provide additional stability to the hurdle so that the hurdle maintains an upright position.

The method 200 may further comprise a Step 204 of joining a single leg with the bottom cross bar in a substantially perpendicular disposition, the single leg having a telescoping interior arm, a non-telescoping exterior arm, and a plurality of spaced-apart cylindrical apertures. The single leg 102 has a telescoping interior arm 104 and a non-telescoping exterior arm 108 that form a sliding relationship. A proximal end 106*a* of the telescoping interior arm 104 is positioned, at least in part, within a hollow cavity 112 of the non-telescoping exterior arm 108.

In some embodiments, a Step 206 includes joining a hurdle cross bar support with a distal end of said telescoping interior arm at a point generally midway between opposite ends of said hurdle cross bar support. A Step 208 comprises joining, in a parallel disposition, a hurdle cross bar with the hurdle cross bar support. The hurdle cross bar support 120 works to support a hurdle cross bar 116 in a horizontal disposition.

A Step 210 includes positioning a proximal end of said telescoping interior arm at least in part within a hollow cavity of said non-telescoping exterior arm such that said telescoping interior arm can be raised or lowered within said cavity due in part to said telescoping interior arm having an exterior cross sectional length sized to correspond with an interior cross sectional length of said single non-telescoping exterior arm.

In some embodiments, a Step 212 may include slidably displacing the telescoping interior arm through the non-telescoping exterior arm to displace the hurdle cross bar to a height. The height is adjustable. Further, since the height is achieved with one leg, the hurdle cross bar 116 more easily maintains a horizontal disposition.

A Step 214 comprises locking the telescoping interior arm at the height by passing a pin through the plurality of spaced-apart cylindrical apertures, whereby the height of the hurdle cross bar is adjustable through selective placement of the pin through one of the plurality of spaced-apart cylindrical apertures.

A final Step 216 includes integrating a counterweight having a predetermined weight in said bottom cross bar, whereby the counterweight helps retain the assembly in a generally upright orientation. The counterweight 128*a*, 128*b* positions along a section of the length of the bottom cross bar 124. The counterweight 128*a*, 128*b* may be repositioned at different sections of the bottom cross bar 124 to correspond with the height of the hurdle cross bar 116.

While the above is a complete description of exemplary specific embodiments of the disclosure, additional embodiments are also possible. Thus, the above description should not be taken as limiting the scope of the disclosure, which is defined by the appended claims along with their full scope of equivalents.

I claim:

1. A hurdle comprising:

a single arm having
a telescoping interior arm and
a non-telescoping exterior arm;

a hurdle cross bar;

a hurdle cross bar support;

a bottom cross bar having a proximal and a distal end;

a first bottom cross bar extension having a proximal and a distal end;

a second bottom cross bar extension having a proximal and a distal end;

wherein a proximal end of said non-telescoping exterior arm and said bottom cross bar are fixedly attached at a point that is generally midway between opposite ends of said bottom cross bar, said bottom cross bar being place-able on the ground as support base for said hurdle, wherein the proximal end of the bottom cross bar is directly and fixedly attached to the proximal end of the first bottom cross bar extension, and the distal end of the bottom cross bar is directly and fixedly attached to the proximal end of the bottom cross bar extension;

wherein a distal end of said telescoping interior arm and said hurdle cross bar support are fixedly attached at a point generally midway between opposite ends of said hurdle cross bar support, a proximal end of said single telescoping interior arm being positioned, at least in part within a hollow cavity of said non-telescoping exterior arm such that said telescoping interior arm can be raised or lowered within said cavity due in part to said telescoping interior arm having an exterior cross sectional length sized to correspond with an interior cross sectional length of said single non-telescoping exterior arm, wherein relative to said single telescoping interior arm that is in a substantially upright direction, said hurdle cross bar support extending along a horizontal direction forming a surface on which said hurdle cross bar is placed, and wherein a proximal end of said hurdle cross bar and a proximal end of said hurdle cross bar support being immovably and fixedly attached while a distal end of said hurdle cross bar and a distal end of said hurdle cross bar support are immovably and fixedly attached.

2. The hurdle of claim 1 wherein said hurdle cross bar is positioned on said hurdle cross bar support so that said single telescoping interior arm is positioned at generally a midway point of the hurdle cross bar.

3. The hurdle of claim 1 further comprising at least one counterweight configured to provide a tip over counterweight.

4. The hurdle of claim 3 wherein said at least one counterweight positions at said pair of bottom cross bar extensions.

5. The hurdle of claim 3 wherein said at least one counterweight selectively positions along the length of said pair of bottom cross bar extensions.

6. The hurdle of claim 3 wherein said at least one counterweight positions at the proximal end of said single non-telescoping exterior arm.

7. The hurdle of claim 1 wherein said telescoping interior arm comprises a plurality of spaced-apart apertures configured to raise or lower said hurdle cross bar at a midway point of said hurdle cross bar without additional legs beyond the telescoping interior arm.

8. The hurdle of claim 7 wherein said plurality of spaced-apart apertures are defined by a generally cylindrical shape.

9. The hurdle of claim 8 further comprising a pin configured to pass through said plurality of spaced-apart apertures, whereby the height of the telescoping interior arm is height adjustable relative to the non-telescoping exterior arm through selective placement of said pin through one of said plurality of spaced-apart apertures.

10. The hurdle of claim 1 wherein said proximal end of said non-telescoping exterior arm and said bottom cross bar are hingedly attached at a point that is generally midway between opposite ends of said bottom cross bar.

11. The hurdle of claim 1 wherein said hurdle cross bar support has a generally V-shape, said V-shaped hurdle cross bar support disposed between said hurdle cross bar and said non-telescoping exterior arm.

12. A hurdle comprising:

a single leg having
a telescoping interior arm,
a non-telescoping exterior arm,
a plurality of spaced-apart cylindrical apertures;

an elongated rectangular cross-sectional hurdle cross bar;

an elongated hurdle cross bar support, having a contiguous flat surface to receive the elongated rectangular cross-section hurdle cross bar;

a bottom cross bar;

a pair of bottom cross bar extensions extending from opposite ends of said bottom cross bar;

wherein a proximal end of said single non-telescoping exterior arm and said bottom cross bar are fixedly attached at a point that is generally midway between opposite ends of said bottom cross bar, said bottom cross bar being placeable on the ground as support base for said hurdle, wherein a distal end of said single telescoping interior arm and said hurdle cross bar support are fixedly attached at a point generally midway between opposite ends of said hurdle cross bar support, a proximal end of said single telescoping interior arm being positioned, at least in part within a hollow cavity of said non-telescoping exterior arm such that said telescoping interior arm can be raised or lowered within said cavity due in part to said telescoping interior arm having an exterior cross sectional length sized to correspond with an interior cross sectional length of said single non-telescoping exterior arm, wherein relative to said single telescoping interior arm that is in a substantially upright direction, said hurdle cross bar support extending along a horizontal direction forming a surface on which said hurdle cross bar is placed, wherein a proximal end of said hurdle cross bar and a proximal end of said hurdle cross bar support being fixedly attached while a distal end of said hurdle cross bar and a distal end of said hurdle cross bar support are fixedly attached, wherein said plurality of spaced-apart cylindrical apertures are configured to raise or lower said hurdle cross bar at a midway point of said hurdle cross bar without additional legs beyond the telescoping interior arm;

at least one counterweight configured to help maintain the hurdle in an upright position, said at least one counterweight positioned at the bottom cross bar; and a pin configured to pass through said plurality of spaced-apart cylindrical apertures, whereby the height of the telescoping interior arm is height adjustable relative to the non-telescoping exterior arm through selective placement of the pin through one of said plurality of spaced-apart cylindrical apertures.

13. The hurdle of claim 12 wherein said hurdle cross bar is positioned on said hurdle cross bar support so that said telescoping interior arm is positioned at generally a midway point of said hurdle cross bar.

14. The hurdle of claim 12 wherein said pair of bottom cross bar extensions are disposed in a spaced-apart parallel relationship.

15. The hurdle of claim 12 further comprising at least one bracket configured to support the fixed attachment between said proximal end of said single non-telescoping exterior arm and said bottom cross bar.

16. A method for constructing a hurdle, said method comprising:

positioning a bottom cross bar coplanar to a ground surface, said bottom cross bar being placeable on the ground surface as support base for said hurdle;

providing a first bottom cross bar extension having a proximal and a distal end;

providing a second bottom cross bar extension having a proximal and a distal end;

wherein the proximal end of the bottom cross bar is directly and fixedly attached to the proximal end of the first bottom cross bar extension, and the distal end of the bottom cross bar is directly and fixedly attached to the proximal end of the bottom cross bar extension;

joining a single leg with the bottom cross bar in a substantially perpendicular disposition, the single leg having a telescoping interior arm, a non-telescoping exterior arm, and a plurality of spaced-apart cylindrical apertures;

joining a hurdle cross bar support with a distal end of said telescoping interior arm at a point generally midway between opposite ends of said hurdle cross bar support;

joining, in a parallel disposition, a hurdle cross bar with the hurdle cross bar support;

positioning a proximal end of said telescoping interior arm at least in part within a hollow cavity of said non-telescoping exterior arm such that said telescoping interior arm can be raised or lowered within said cavity due in part to said telescoping interior arm having an exterior cross sectional length sized to correspond with an interior cross sectional length of said single non-telescoping exterior arm;

slidably displacing the telescoping interior arm through the non-telescoping exterior arm to displace the hurdle cross bar to a height;

locking the telescoping interior arm at the height by passing a pin through the plurality of spaced-apart cylindrical apertures, whereby the height of the hurdle cross bar is adjustable through selective placement of the pin through one of the plurality of spaced-apart cylindrical apertures; and integrating at least one counterweight having a predetermined weight in said bottom cross bar, whereby the at least one counterweight helps retain the assembly in a generally upright orientation.

* * * * *